US006976476B1

(12) United States Patent
Mantri

(10) Patent No.: US 6,976,476 B1
(45) Date of Patent: Dec. 20, 2005

(54) FUEL PUMP DRIVE SYSTEM IN AN INTERNAL COMBUSTION ENGINE

(75) Inventor: Subhash V. Mantri, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/945,582

(22) Filed: Sep. 21, 2004

(51) Int. Cl.[7] ..... F02M 37/04
(52) U.S. Cl. ..... 123/508; 123/195 A
(58) Field of Search ..... 123/508, 509, 123/495, 195 A, 90.31, 90.27, 195 C, 195 R, 123/90.38

(56) References Cited

U.S. PATENT DOCUMENTS 4,480,600 A * 11/1984 Gill ..... 123/54.5
4,516,546 A * 5/1985 Choushi et al. ..... 123/195 A
4,658,769 A * 4/1987 Horio et al. ..... 123/90.31
4,662,320 A * 5/1987 Moriya ..... 123/41.44
4,674,452 A * 6/1987 Asanomi ..... 123/90.31
4,915,066 A * 4/1990 Koshimoto et al. ..... 123/90.27
5,419,298 A * 5/1995 Nolte et al. ..... 123/508
5,735,239 A * 4/1998 Sugano et al. ..... 123/90.31
5,975,060 A * 11/1999 Stover et al. ..... 123/508
6,148,787 A * 11/2000 Takano ..... 123/195 A
6,298,815 B1 * 10/2001 Kashima et al. ..... 123/184.21
6,346,018 B1 * 2/2002 Watanabe ..... 440/77
2004/0187812 A1 * 9/2004 Czysz ..... 123/59.6

* cited by examiner

*Primary Examiner*—Carl S. Miller
(74) *Attorney, Agent, or Firm*—Susan L. Lukasik; Dennis Kelly Sullivan; Jeffrey P. Calfa

(57) ABSTRACT

A fuel pump drive system for an internal combustion engine uses a cam-to-cam gear from a double overhead camshaft to rotate a fuel pump gear. The fuel pump drive system may have a primary camshaft, a secondary camshaft, and the fuel pump. The primary camshaft has a camshaft gear and the cam-to-cam gear. The secondary camshaft has a cam gear. The cam gear engages the cam-to-cam gear. The fuel pump has a fuel pump gear that engages the cam-to-cam gear. The fuel pump gear drives the fuel pump.

11 Claims, 5 Drawing Sheets

FUEL PUMP DRIVE SYSTEM IN AN INTERNAL COMBUSTION ENGINE

FIELD OF THE INVENTION

This invention generally relates to internal combustion engines with overhead camshafts, including, but not limited to, internal combustion engines with double overhead camshafts and mechanically driven fuel pumps.

BACKGROUND OF THE INVENTION

Internal combustions engines convert chemical energy from a fuel into mechanical energy. The fuel may be petroleum-based (gasoline or diesel), natural gas, a combination thereof, or the like. Some internal combustion engines, such as gasoline engines, inject an air-fuel mixture into one or more cylinders for ignition by a spark from a spark plug or the like. Other internal combustion engines, such as diesel engines, compress air in the cylinder and then inject fuel into the cylinder for the compressed air to ignite. A diesel engine may use a hydraulically activated electronically controlled unit injection (HEUI) system or the like to control the fuel injection into the cylinders. The ignited fuel generates rapidly expanding gases that actuate a piston in the cylinder. Each piston usually is connected to a crankshaft or similar device for converting the reciprocating motion of the piston into rotational motion. The rotational motion from the crankshaft may be used to propel a vehicle, operate a pump or an electrical generator, or perform other work. The vehicle may be a truck, an automobile, a boat, or the like.

Each cylinder in an internal combustion engine usually has one or more intake valves and one or more exhaust valves. The intake valves open for air or an air-fuel mixture to enter the cylinder. The exhaust valves open for exhaust cases to exit the cylinder. The internal combustion engine typically uses a camshaft to operate the intake and exhaust valves.

A camshaft typically is a rod with one or more cams that convert the rotational motion of the rod into reciprocating motion. A cam is an irregularly shaped disk or projection extending radially from the rod. When the camshaft rotates, a cam causes a part in contact with the cam to move up and down. In some internal combustion engines, the cams on the camshaft are connected to push rods that actuate rocker arms to operate the intake and exhaust valves. In other internal combustion engines, the cams on the camshaft are connected directly to the intake and exhaust valves for operation. Some internal combustion engines use a single overhead camshaft to operate the intake and exhaust valves. Other internal combustion engines use a double overhead camshaft to operate the intake and exhaust valves.

A double overhead camshaft typically has two camshafts—a first camshaft to operate the intake valves and a second camshaft to operate the exhaust valves. The camshafts are positioned in the cylinder head above the valves. The cams on the camshafts connect directly to the respective intake and exhaust valves. The first camshaft usually has a camshaft gear that is connected by a timing belt or chain to the crankshaft of the internal combustion engine. A cam-to-cam gear connects the camshafts. The cam-to-cam gear usually is mounted on the first camshaft adjacent to the camshaft gear. When the crankshaft rotates, the timing chain causes the camshaft gear to rotate the first camshaft. The rotation of the first camshaft causes the cam-to-cam gear to rotate the second camshaft. The rotation of the camshafts causes the intake and exhaust valves to open and close.

Most internal combustion engines have a fuel pump to supply fuel to the cylinders. Many fuel pumps are mechanically driven by the rotational motion of the engine. Mechanically-driven fuel pumps typically have either a fuel pump gear or a fuel pump pulley to operate the pump.

Some fuel pumps with a fuel pump gear may be connected to a crankshaft gear. An idler gear may be positioned between the fuel pump gear and the crankshaft gear. The idler gear is an additional part that may increase assembly and maintenance costs and may increase power transmission losses from the crankshaft. The connection of the fuel pump gear to the crankshaft gear via an idler gear typically restricts the location of the fuel pump to positions near the crankshaft gear.

Other fuel pumps with a fuel pump gear may be connected to a camshaft gear. The position of the cam-to-cam gear in a double overhead camshaft may prevent or restrict the connection of the fuel pump gear to the camshaft gear. An idler gear and/or other extension to the fuel pump gear may be used, but may increase costs and increase power transmission losses in the engine.

Most fuel pumps with a fuel pump pulley are connected to the crankshaft gear by a drive belt. The drive belt is an additional part that may increase assembly and maintenance costs and may increase power transmission losses from the crankshaft. The drive belt connection of a fuel pump pulley to the crankshaft may increase the space requirements of the engine.

SUMMARY

A fuel pump drive system is provided for an internal combustion engine with a double overhead camshaft. A cam-to-cam gear in the double overhead camshaft rotates a fuel pump gear to drive the fuel pump.

A fuel pump drive system in an internal combustion engine may have a primary camshaft, a secondary camshaft, and a fuel pump. The primary camshaft is disposed in a cylinder head. The primary camshaft has a camshaft gear and a cam-to-cam gear. The secondary camshaft is disposed in the cylinder head. The secondary camshaft has a cam gear. The cam gear engages the cam-to-cam gear. The fuel pump is connected to the cylinder head. The fuel pump has a fuel pump gear that engages the cam-to-cam gear.

A fuel pump drive system in an internal combustion engine may have a first primary camshaft, a first secondary camshaft, a fuel pump, a second primary camshaft, and a second secondary camshaft. The first primary camshaft is disposed in a first cylinder head. The first primary camshaft has a first camshaft gear and a first cam-to-cam gear. The first secondary camshaft is disposed in the first cylinder head. The first secondary camshaft has a first cam gear that engages the first cam-to-cam gear. The fuel pump is connected to the first cylinder head. The fuel pump has a fuel pump gear that engages the first cam-to-cam gear. The second primary camshaft is disposed in a second cylinder head. The second primary camshaft has a second camshaft gear and a second cam-to-cam gear. The second secondary camshaft is disposed in the second cylinder head. The second secondary camshaft has a second cam gear that engages the second cam-to-cam gear. A crankcase is connected to the first and second cylinder heads.

In a method for driving a fuel pump in an internal combustion engine, one or more primary camshafts are rotated. One or more cam-to cam gears are rotated in response to the primary camshafts. One or more secondary camshafts are rotated in response to the cam-to-cam gears. A fuel pump gear is rotated in response to one of the cam-to-cam gears.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the claims that follow.

BRIEF DESCRIPTION OF THE DRAWINGS

The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
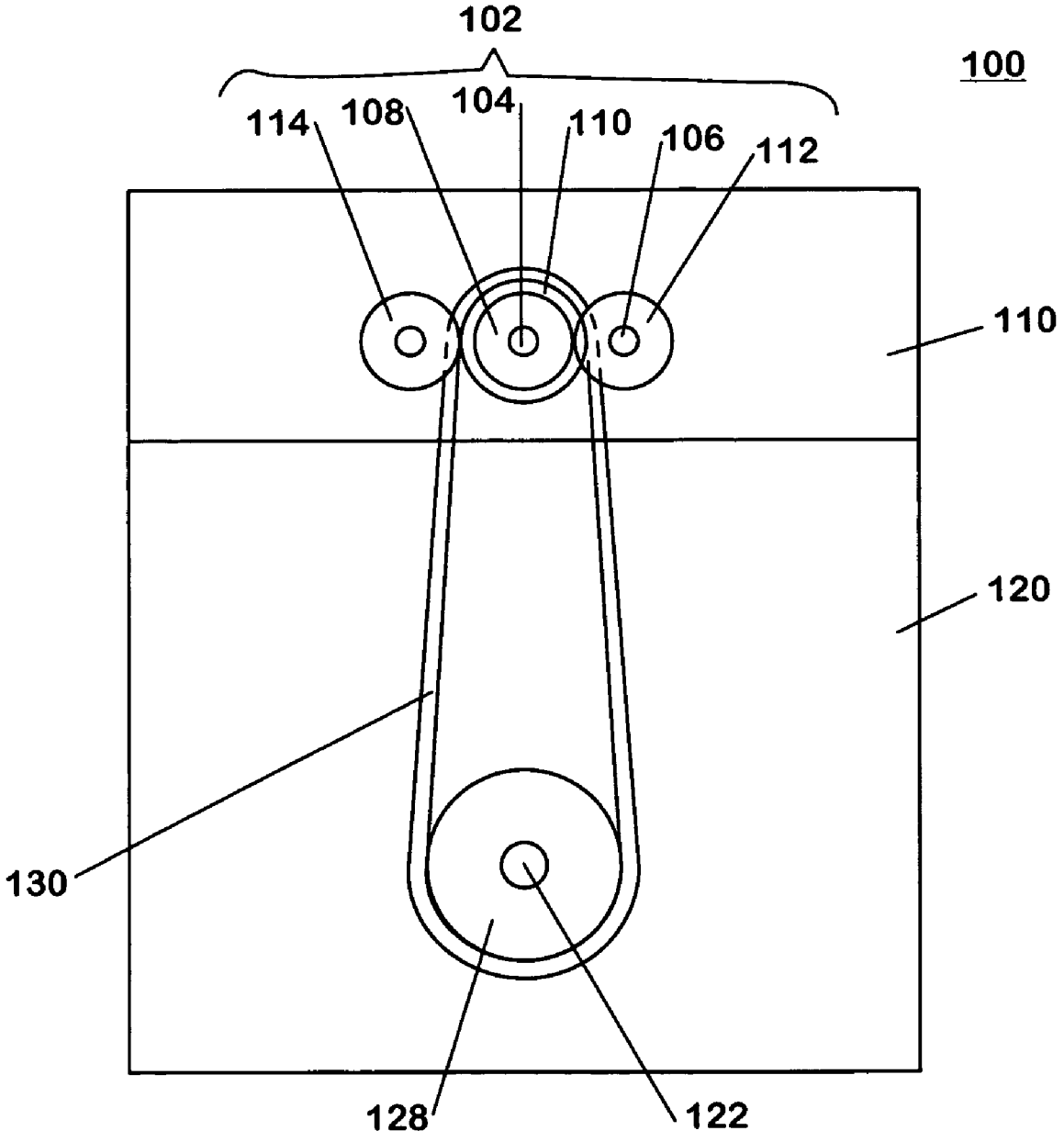
FIG. 1 is a front schematic view of a fuel pump drive system in an internal combustion engine in accordance with the invention.
Figure 2:
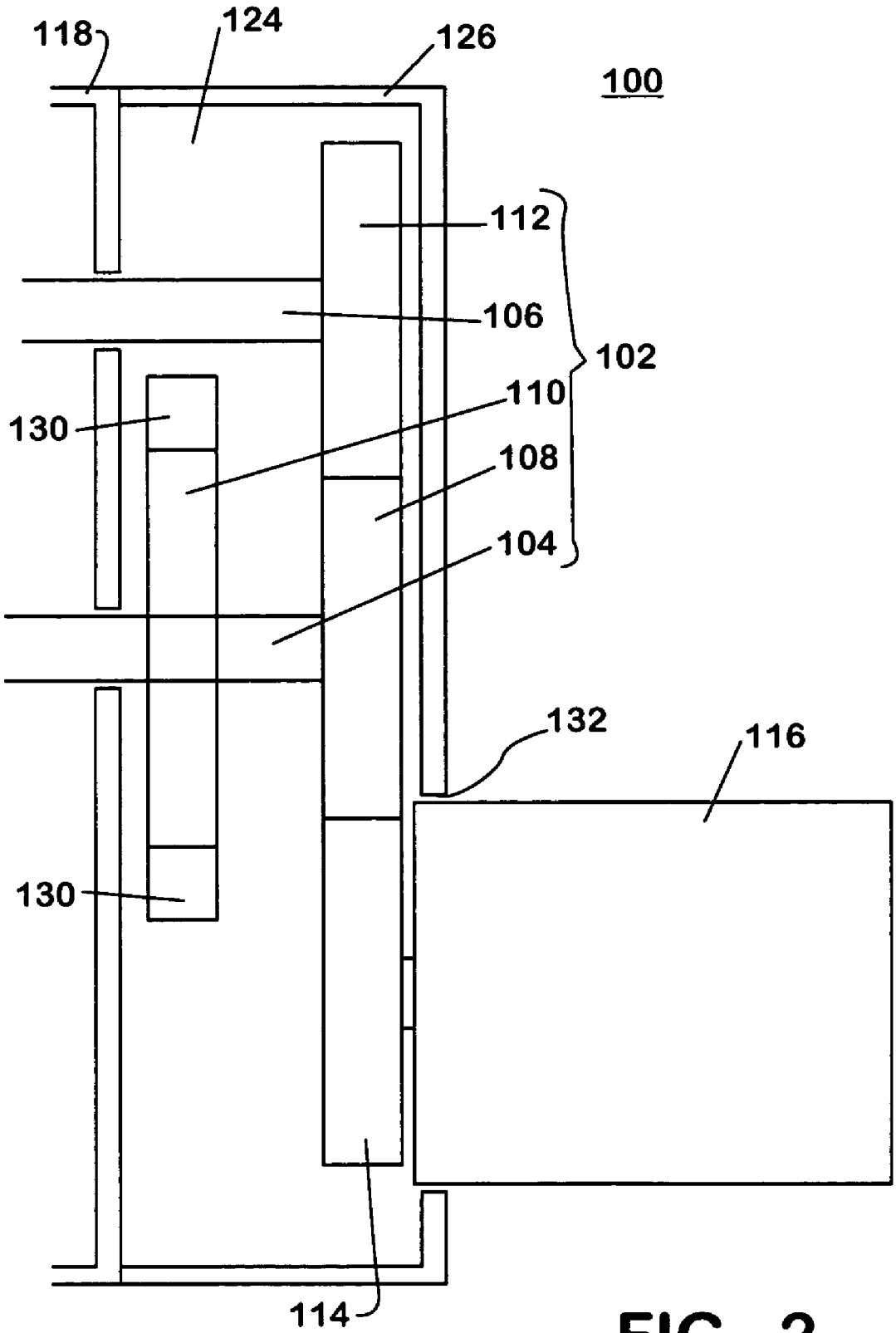
FIG. 2 is a top schematic view of the fuel pump drive system in accordance with the invention.

FIGS. 1 and 2 are schematic views of a fuel pump drive system in an internal combustion engine 100. A double overhead camshaft 102 is disposed in the internal combustion engine 100. The double overhead camshaft 102 includes a primary camshaft 104 and a secondary camshaft 106. The primary camshaft 104 has a cam-to-cam gear 108 and a camshaft gear 110. The cam-to-cam gear 108 engages a cam gear 112 on the secondary camshaft 106. The cam-to-cam gear 108 also engages a fuel pump gear 114 connected to a fuel pump 116. During operation of the internal combustion engine 100, the primary camshaft 104 rotates the cam-to-cam gear 108. The rotation of the cam-to-cam gear 108 turns the cam gear 112 and the fuel pump gear 114. The rotation of the cam gear 112 turns the secondary camshaft 106. The rotation of the fuel pump gear 114 drives the fuel pump 116. While a particular configuration is shown, the fuel pump drive system may have other configurations including those with additional components.

The internal combustion engine 100 has a cylinder head 118 mounted on a crankcase 120. The crankcase 120 forms one or more cylinders (not shown) each with a piston (not shown) disposed therein. The pistons are connected to a crankshaft 122 disposed beneath the cylinders in the crankcase 120. The cylinder head 118 covers the top of each cylinder and forms openings into each cylinder for one or more intake valves (not shown) and one or more exhaust valves (not shown). The cylinders may have an in-line, vee, or other configuration.

The double overhead camshaft 102 is disposed in the cylinder head 118 above the intake and exhaust valves. The primary camshaft 104 has one or more cams that may be connected to the intake valves. The primary camshaft 104 may be connected to the exhaust valves. The secondary camshaft 106 has one or more cams that may be connected to the exhaust valves. The secondary camshaft 106 may be connected to the intake valves. The cam-to-cam gear 108 is mounted on or near one end of the primary camshaft 104. The camshaft gear 110 is mounted on the primary camshaft 104 adjacent to the cam-to-cam gear 108. The cam gear 112 is mounted on or near one end of the secondary camshaft 106. When assembled, the cam-to-cam gear 108 engages the cam gear 112. The gear ratio between the cam-to-cam gear 108 and the cam gear 112 may be selected to provide a desired rotational velocity and/or torque of the secondary camshaft 106 in relation to the primary camshaft 104. The rotational velocity and torque of the primary camshaft 104 and the secondary camshaft 106 may be substantially the same. The primary camshaft 104 and secondary camshaft 106 may extend out of the cylinder head 118 and position the cam-to-cam gear 108 and cam gear 112 within a cavity 124 formed by a front cover 126 attached to the cylinder head 118 and crankcase 120.

The fuel pump 116 is mechanically driven and is mounted in an opening 132 formed by the front cover 126 near the double overhead camshaft 102. The fuel pump 116 is connected to a fuel pump gear 114, which is disposed within the cavity 124. When assembled, the fuel pump gear 114 engages the cam-to-cam gear 108. The gear ratio between the cam-to-cam gear 108 and the fuel pump gear 114 may be selected to provide a desired rotational velocity and/or torque to the fuel pump 116 in relation to the primary camshaft 104.

The crankshaft 122 has a crankshaft gear 128 mounted on or near one end. The crankshaft 122 may extend out of the crankcase 120 and position the crankshaft gear 128 within the cavity 124 formed by the front cover 126 when attached to the crankcase 128. A drive device 130 connects the crankshaft gear 128 with the camshaft gear 110. The drive device 130 may be a drive chain, a drive belt, or the like. The gear ratio between the camshaft gear 110 and the crankshaft gear 128 may be selected to provide a desired rotational velocity and/or torque of the primary camshaft 104 in relation to the crankshaft 122.

During engine operation, the crankshaft 122 rotates thus turning the crankshaft gear 128. The rotation of the crankshaft gear 128 turns the drive device 130, which rotates the camshaft gear 110. The rotation of the camshaft gear 110 turns primary camshaft 104 and thus the cam-to-cam gear 108. The rotation of the cam-to-cam gear 108 turns the cam gear 112 and the fuel pump gear 114. The rotation of the cam gear 112 turns the secondary camshaft 106. The rotation of the fuel pump gear 114 drives the fuel pump 116.

Figure 3:
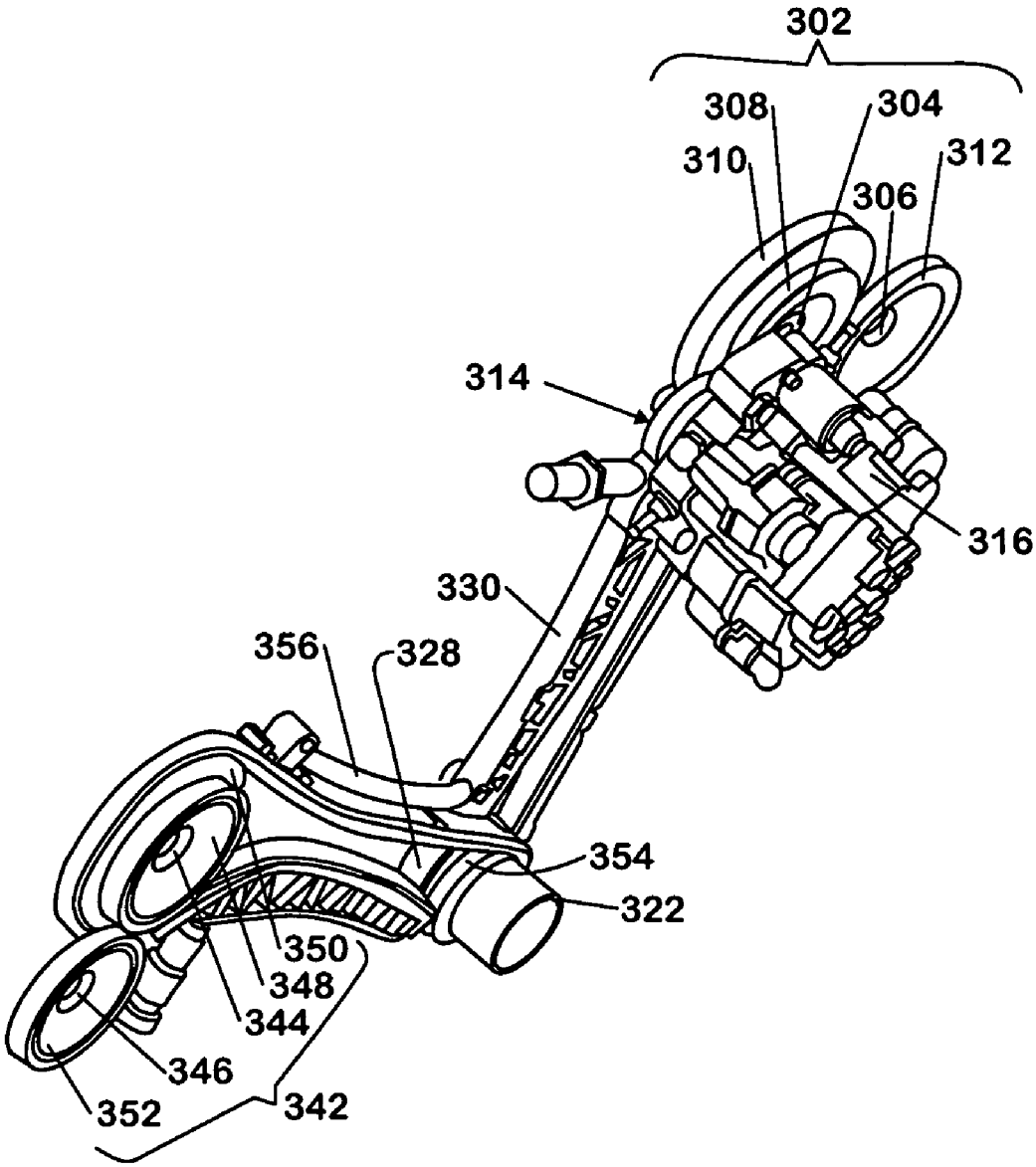
FIG. 3 is a cutaway perspective view of another fuel pump drive system for an internal combustion engine in accordance with the invention.
Figure 4:
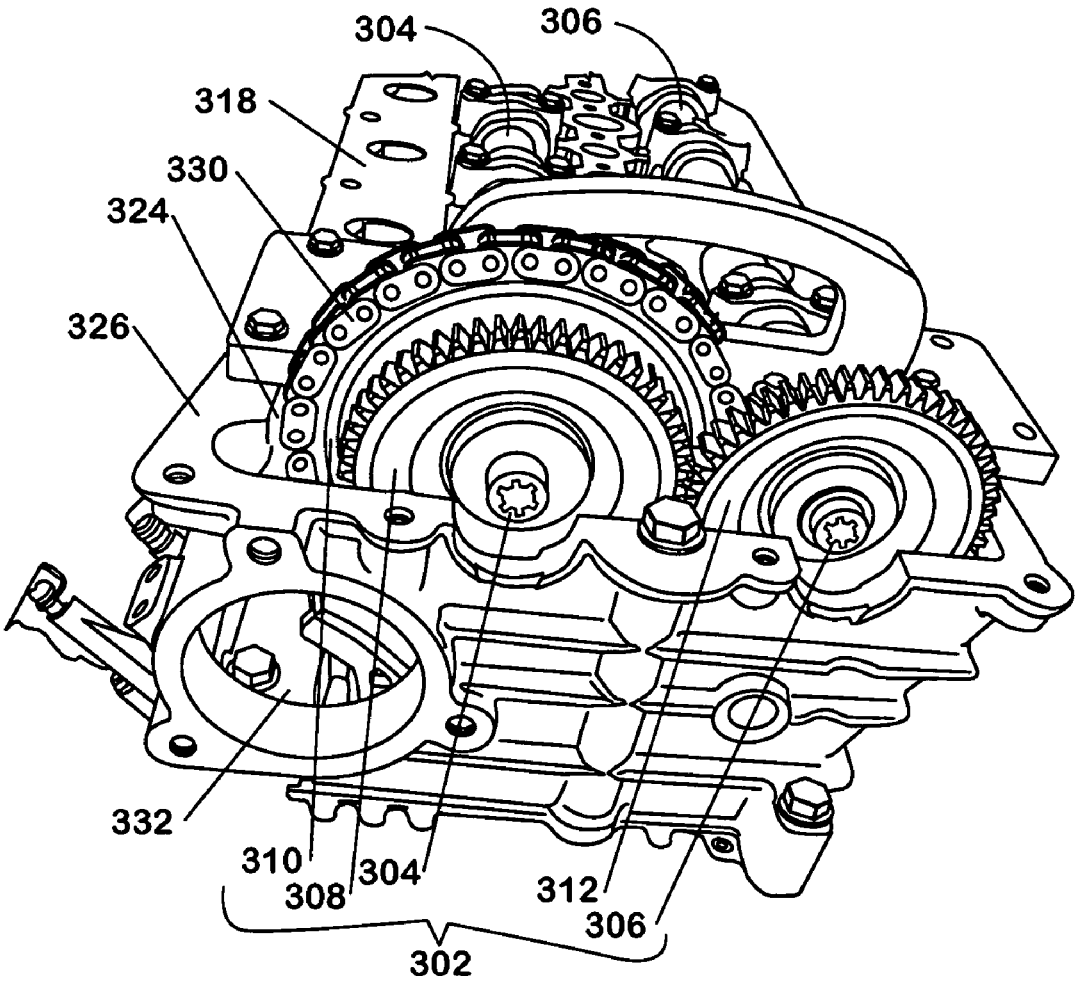
FIG. 4 is a cutaway perspective view of a cylinder head with the fuel pump drive system of FIG. 3 in accordance with the invention.

FIGS. 3 and 4 are perspective views of another fuel pump drive system for an internal combustion engine. The fuel pump system is configured for an internal combustion engine where the cylinders have a vee arrangement. The internal combustion engine has two cylinder heads mounted on a crankcase. The internal combustion engine has two double overhead camshafts, each disposed in one of the cylinder heads. The crankcase forms two banks or rows of one or more cylinders (not shown), each with a piston (not shown) disposed therein. The pistons are connected to a crankshaft 322 disposed beneath the cylinders in the crankcase. The cylinder heads cover the tops of the cylinders and form openings into each cylinder for one or more intake valves (not shown) and one or more exhaust valves (not shown).

The first double overhead camshaft 302 is disposed in a first cylinder head 318 above the intake and exhaust valves (not shown) extending into the cylinders. The first double overhead camshaft 302 has a first primary camshaft 304 and a first secondary camshaft 306. The first primary camshaft 304 has one or more cams connected to the intake valves in the first cylinder head. The first primary camshaft 304 may be connected to the exhaust valves. The first secondary camshaft 306 has one or more cams connected to the exhaust valves in the first cylinder head. The first secondary camshaft may be connected to the intake valves. A first cam-to-cam gear 308 is mounted on or near one end of the first primary camshaft 304. A first camshaft gear 310 is mounted on the first primary camshaft 304 adjacent to the first cam-to-cam gear 308. A first cam gear 312 is mounted on or near one end of the first secondary camshaft 306. When assembled, the first cam-to-cam gear 308 engages the first cam gear 312. The gear ratio between the first cam-to-cam gear 308 and the first cam gear 312 may be selected to provide a desired rotational velocity and/or torque of the first secondary camshaft 306 in relation to the first primary camshaft 304. The rotational velocity and torque of the first primary camshaft 304 and the first secondary camshaft 306 may be substantially the same. The first primary camshaft 304 and the first secondary camshaft 306 may extend out of the first cylinder head 318 and position the first cam-to-cam gear 308 and the cam gear 312 within a cavity 324 formed by a first front cover 326 attached to the first cylinder head 318.

The second double overhead camshaft 342 is disposed in a second cylinder head (not shown) above the intake and exhaust valves (not shown) extending into the cylinders. The second double overhead camshaft 342 has a second primary camshaft 344 and a second secondary camshaft 346. The second primary camshaft 344 has one or more cams connected to the intake valves in the second cylinder head. The second primary camshaft 344 may be connected to the exhaust valves. The second secondary camshaft 346 has one or more cams connected to the exhaust valves in the second cylinder head. The second secondary 346 camshaft may be connected to the intake valves. A second cam-to-cam gear 348 is mounted on or near one end of the second primary camshaft 344. A second camshaft gear 350 is mounted on the second primary camshaft 344 adjacent to the second cam-to-cam gear 348. A second cam gear 352 is mounted on or near one end of the second secondary camshaft 346. When assembled, the second cam-to-cam gear 348 engages the second cam gear 352. The gear ratio between the second cam-to-cam gear 348 and the second cam gear 352 may be selected to provide a desired rotational velocity and/or torque of the second secondary camshaft 346 in relation to the second primary camshaft 344. The rotational velocity and torque of the second primary camshaft 344 and the second secondary camshaft 346 may be substantially the same. The second primary camshaft 344 and the second secondary camshaft 346 may extend out of the second cylinder head and position the second cam-to-cam gear 348 and the second cam gear 352 within a cavity formed by a front cover attached to the cylinder head.

The fuel pump 316 is mechanically driven and is mounted in an opening 332 formed by the first front cover 326 near the first double overhead camshaft 302. The fuel pump 316 is connected to a fuel pump gear 314, which is disposed within the first cavity 324 formed by the first front cover 326. When assembled, the fuel pump gear 314 engages the cam-to-cam gear 308. The gear ratio between the cam-to-cam gear 308 and the fuel pump gear 314 may be selected to provide a desired rotational velocity and/or torque to the fuel pump 316 in relation to the first primary camshaft 304.

The crankshaft 322 is disposed in a crankcase (not shown) beneath the cylinders. The crankshaft 322 has a first crankshaft gear 328 and a second crankshaft gear 354 mounted adjacent to each other and on or near one end of the crankshaft 322. The crankshaft 322 may extend out of the crankcase and position the first crankshaft gear 328 and the second crankshaft gear 354 within a cavity formed by a front cover.

A first drive device 330 engages the first crankshaft gear 328 and the first camshaft gear 310. The gear ratio between the first camshaft gear 310 and the first crankshaft gear 328 may be selected to provide a desired rotational velocity and/or torque of the first primary camshaft 304 in relation to the crankshaft 322.

A second drive device 356 engages the second crankshaft gear 354 with the second camshaft gear 350. The gear ratio between the second camshaft gear 350 and the second crankshaft gear 354 may be selected to provide a desired rotational velocity and/or torque of the second primary camshaft 344 in relation to the crankshaft 322. The first and second drive devices 330 and 356 may be drive chains, a drive belts, a combination thereof, or the like.

During engine operation, the crankshaft 322 rotates and thus turns the first crankshaft gear 328 and the second crankshaft gear 354. The rotation of the first crankshaft gear 328 turns the first drive device 330, which rotates the first camshaft gear 310. The rotation of the first camshaft gear 310 turns the first primary camshaft 304, which rotates the first cam-to-cam gear 308. The rotation of the first cam-to-cam gear 308 turns the first cam gear 312 and the fuel pump gear 314. The rotation of the first cam gear 312 turns the first secondary camshaft 306. The rotation of the fuel pump gear 314 drives the fuel pump 316.

The rotation of the second crankshaft gear 356 turns the second drive device 356, which rotates the first secondary camshaft gear 350. The rotation of the second camshaft gear 350 turns the second primary camshaft 344, which rotates the second cam-to-cam gear 348. The rotation of the second cam-to-cam gear 348 turns the second cam gear 352. The rotation of the second cam gear 352 turns the second secondary camshaft 346.

Figure 5:
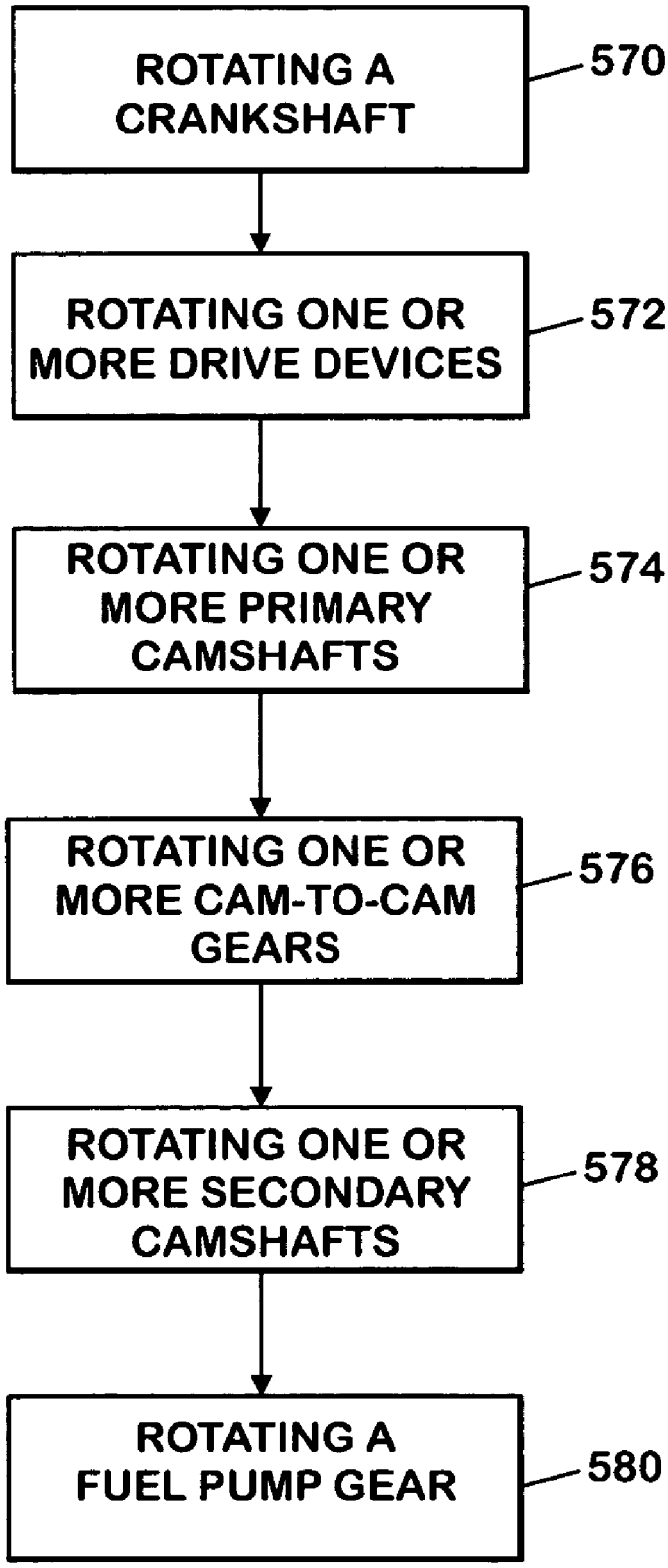
FIG. 5 is a flowchart of a method for driving a fuel pump in an internal combustion engine in accordance with the invention.

FIG. 5 is a flowchart of a method for driving a fuel pump in an internal combustion engine. A cam-to-cam gear in a double overhead camshaft rotates a fuel pump gear to drive the fuel pump as previously discussed.

In block 570, a crankshaft is rotated in an internal combustion engine. The crankshaft is disposed in the crankcase. One or more crankshaft gears are mounted on the crankshaft. The rotation of the crankshaft rotates the crankshaft gears.

In block 572, one or more drive devices are rotated. Each drive device engages a crankshaft gear on the crankshaft. The rotation of the crankshaft gear turns the drive device. The drive devices could be drive belts, drive chains, a combination thereof, or the like.

In block 574, one or more primary camshafts are rotated. Each drive device engages a camshaft gear mounted on a primary camshaft. The drive device turns the camshaft gear thus rotating the primary camshaft.

In block 576, one or more cam-to-cam gears are rotated. Each cam-to-cam gear is mounted on a primary camshaft. The rotation of the primary camshaft turns the cam-to-cam gear.

In block 578, one or more secondary camshafts are rotated. Each secondary camshaft has a cam gear that engages the cam-to-cam gear. The rotation of the cam-to-cam gear rotates the cam gear thus turning the secondary camshafts.

In block 580, the fuel pump gear is rotated. The fuel pump gear engages the cam-to-cam gear. The rotation of the cam-to-cam gear turns the fuel pump gear. The rotation of the fuel pump gear drives the fuel pump.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A fuel pump drive system comprising:

a primary camshaft disposed in a cylinder head, wherein the primary camshaft has a camshaft gear and a cam-to-cam gear;

a secondary camshaft disposed in the cylinder head, wherein the secondary camshaft has a cam gear, and wherein the cam gear engages the cam-to-cam gear; and a fuel pump connected to the cylinder head, wherein the fuel pump has a fuel pump gear, wherein the fuel pump gear engages the cam-to-cam gear and wherein the fuel pump is mounted in an opening formed by a front cover attached to the cylinder head.

2. The fuel pump drive system of claim 1, wherein at least one of the camshaft gear, cam-to-cam gear, cam gear, and fuel pump gear are disposed in a cavity formed by a front cover attached to the cylinder head.

3. The fuel pump drive system of claim 1, further comprising:

a crankshaft disposed in a crankcase, wherein the crankshaft has a crankshaft gear; and a drive device that engages the crankshaft gear and the camshaft gear.

4. The fuel pump drive system of claim 3, wherein the crankshaft gear is disposed in a cavity formed by a front cover attached to the cylinder head.

5. A fuel pump drive system comprising:

a first primary camshaft disposed in a first cylinder head, wherein the first primary camshaft has a first camshaft gear and a first cam-to-cam gear;

a first secondary camshaft disposed in the first cylinder head, wherein the first secondary camshaft has a first cam gear, and wherein the first cam gear engages the first cam-to-cam gear;

a fuel pump connected to the first cylinder head, wherein the fuel pump has a fuel pump gear, wherein the fuel pump gear engages the first cam-to-cam gear and wherein the fuel pump is mounted in an opening formed by a front cover attached to the first cylinder head;

a second primary camshaft disposed in a second cylinder head, wherein the second primary camshaft has a second camshaft gear and a second cam-to-cam gear;

a second secondary camshaft disposed in the second cylinder head, wherein the second secondary camshaft has a second cam gear, and wherein the second cam gear engages the second cam-to-cam gear; and a crankcase connected to the first and second cylinder heads.

6. The fuel pump drive system of claim 5, further comprising:

a crankshaft disposed in the crankcase, wherein the crankshaft has a first crankshaft gear and a second crankshaft gear;

a first drive device that engages the first crankshaft gear and the first camshaft gear; and a second drive device that engages the second crankshaft gear and the second camshaft gear.

7. A method comprising the steps of:

rotating at least one primary camshaft;

rotating at least one cam-to-cam gear in response to the at least one primary camshaft;

rotating at least one secondary camshaft in response to the at least one cam-to-cam gear; and rotating a fuel pump gear in response to one of the at least one cam-to-cam gear, wherein the fuel pump gear is separate from the at least one cam-to-cam gear.

8. The method of claim 7, further comprising the steps of:

rotating a crankshaft;

rotating at least one drive device in response to the crankshaft; and rotating the at least one primary camshaft in response to the at least one drive device.

9. The method of claim 7, further comprising the steps of:

rotating a first primary camshaft;

rotating a first cam-to cam gear in response to the first primary camshaft;

rotating a first secondary camshaft in response to the first cam-to-cam gear; and rotating a fuel pump gear in response to the cam-to-cam gear.

10. The method of claim 9, further comprising the steps of:

rotating a second primary camshaft;

rotating a second cam-to cam gear in response to the second primary camshaft; and rotating a second secondary camshaft in response to the second cam-to-cam gear.

11. The method of claim 10, further comprising the steps of:

rotating a crankshaft;

rotating a first drive device in response to the crankshaft;

rotating a second drive device in response to the crankshaft;

rotating the first primary camshaft in response to the first drive device; and rotating the second primary camshaft in response to the second drive device.

* * * * *